US005556357A

United States Patent [19]

Hanna

[11] Patent Number: 5,556,357

[45] Date of Patent: Sep. 17, 1996

[54] FACE, NECK AND CHIN EXERCISER

[76] Inventor: Beverly I. Hanna, 7954 Two Mile Rd., Lakeview, Mich. 48850

[21] Appl. No.: 565,625

[22] Filed: Nov. 14, 1995

[51] Int. Cl.[6] ..... A63B 23/03; A63B 21/02

[52] U.S. Cl. ..... 482/11; 482/124; 601/38; 601/39

[58] Field of Search ..... 482/10, 11, 121, 482/122, 124; 601/23, 38, 39; 128/777, 848, 859–862; 606/204.15; 600/242; 433/5–7

[56] References Cited

U.S. PATENT DOCUMENTS

| | | | |
|---|---|---|---|
| 1,363,534 | 12/1920 | Rogers | 482/11 |
| 1,439,910 | 12/1922 | Posa | 606/204.15 |
| 1,775,718 | 9/1930 | Garvey | 128/848 |
| 3,058,462 | 10/1962 | Greenblum | 128/861 |
| 3,207,153 | 9/1965 | Goldstein | 128/862 |
| 3,224,442 | 12/1965 | Stubbs | 128/859 |
| 3,525,520 | 8/1970 | Dwyer | 482/11 |
| 3,528,655 | 9/1970 | Ruderian . | |
| 3,556,093 | 1/1971 | Quick | 433/6 |
| 3,813,096 | 5/1974 | Welch . | |
| 4,170,230 | 10/1979 | Nelson | 128/859 |
| 4,671,260 | 6/1987 | Buckner | 482/11 |
| 5,174,284 | 12/1992 | Jackson | 128/859 |
| 5,469,865 | 11/1995 | Minneman | 128/861 |

FOREIGN PATENT DOCUMENTS

| | | | |
|---|---|---|---|
| 3924809 | 2/1991 | Germany | 433/6 |

OTHER PUBLICATIONS

*The New Yorker*, Oct. 9, 1995, p. 39.

*Primary Examiner*—Richard J. Apley
*Assistant Examiner*—Victor K. Hwang
*Attorney, Agent, or Firm*—Sterne, Kessler, Goldstein & Fox P.L.L.C.

[57] ABSTRACT

An exerciser device of the present invention is disposed in the mouth for exercising in the mouth through the use of tension. The exerciser device of the present invention includes a guard strip for passing over the front and sides of the upper and lower teeth. A grip piece extending form an inside of the guard strip is used for gripping and holding the guard strip in position during use. Preferably, the guard strip comprises a pair of tabs separated from each other such that the upper and lower teeth are separated from each other to avoid discomfort caused by the upper and lower teeth being clenched. An elastic member anchored in a first corner of the mouth passes along a first side of the teeth towards the back of the mouth, passes through an opening in a distal end of the mouth guard, crosses the back of the mouth, and passes through another opening in the distal end of the guard strip on the other side of the mouth and then extends from the rear of the mouth toward the front of the mouth for being anchored in the other corner of the mouth. Accordingly, when the shape of the mouth is moved between and "O" shape and a smile shape, the elastic member changes the degree of tension, thereby exercising the muscles in the face, chin and neck.

13 Claims, 4 Drawing Sheets

FACE, NECK AND CHIN EXERCISER

BACKGROUND OF THE INVENTION

1. Field of the Invention

The invention relates to a face, neck and chin exerciser. More particularly, the invention relates to an exerciser device fully mounted inside the mouth that exercises the muscles surrounding the mouth using resistance or tension.

2. Related Art

The desire to reduce or slow the effects of aging is omnipresent. Often, painful surgical procedures are endured in an effort to have a younger appearing face and neck. Less intrusive ways of reducing the effects of aging have been attempted through the use of exercise devices, which frequently do not yield the results promised.

For example, U.S. Pat. No. 3,528,655 to Ruderian discloses a facial muscle- and skin-conditioning device. This device comprises a resilient strip curved into an arch-shaped configuration that is disposed in a person's mouth. Contraction of the cheek muscles to bring the inner surfaces of the cheek closer together press the diverging ends of the arch closer together. This in turn, exerts a forward-protruding pressure on the central portion of the curved strip to stretch the lips, thereby effecting exercising of the facial muscles and associated skin. Disk-shaped extenders may be added on the sides of the curved strip to accommodate people having larger-than-average mouths.

However, during exercise, this device has a tendency to dislodge or pop out of the mouth. Therefore, to use such a device, it is necessary to use your hand to hold the device in one's mouth. Moreover, this device fails to provide sufficient flexing of the muscles to achieve noticeable results. Furthermore, the semi-rigid materials that need to be used for this device are painful to the tender mouth tissue and put stress on the teeth and mouth.

In addition, a device sold under the trademark Facial-Flex® is purported to provide the effects of a face lift without surgery. See, for example, an advertisement for the Facial-Flex® device from "The New Yorker," Oct. 9, 1995, p. 39. With this device, two U-shaped portions are wedged in the corners of the mouth. Then, the mouth is moved such that the interconnecting rods expand and contract linearly. However, the use of this device does not provide any support for retaining the shape of the lips, and therefore, deep wrinkles extending perpendicularly from the lips, which are often called "whistle-marks," may form with the extended use of this device. Moreover, this device utilizes metal rods which may present safety problems. For example, if this exercising device is used while driving or engaging in athletic activity and an accident occurs, the metal rods may puncture or wound the mouth. Furthermore, the use of this device may interfere with bridge-work or weakened teeth.

SUMMARY OF THE INVENTION

Accordingly, it is an advantage of the invention to have an exerciser device that firms and tightens the face, chin and neck without causing new wrinkles.

It is another advantage of the invention to have an exerciser device that can be held in the user's mouth without having to hold the device in the mouth with your hand.

It is a further advantage of the invention to have a safe, flexible exerciser device that will not puncture the mouth in the event of an accident.

It is yet another advantage of the invention to have an exerciser device that will not weaken or apply pressure to teeth that have been weakened by periodontal disease, bridge-work or dentures.

The exercise device of the present invention is fully positioned within an exerciser's mouth. The exercise device supplies resistance or tension so that movement of the mouth between a smile shape and an O-shape, causes the face, neck and chin to be exercised. The exercise device comprises a guard strip, a grip piece and an elastic member. The guard strip has a central portion with a first leg extending from the central portion and a second leg extending the central portion in a direction opposing the first leg so as to form substantially an arch shape when positioned in the mouth to correspond to the arch shape of the tooth line.

A grip piece extending from a side of the central portion of the guard strip gripped or bitten by the wearer to hold the exercise device in the mouth without the use of the exerciser's hand. The elastic member cooperates with the first and second legs of the guard strip. A first end of the elastic band of the elastic member has a first anchor for being positioned in a first corner of the mouth and a second end of the elastic band has a second anchor for being positioned in a second corner of the mouth. By anchoring the anchors in the corners of the mouth, the elastic band is tensioned.

The elastic member is positioned in the mouth so as to apply tension to the corners of the mouth. Thus, movement and shaping of the mouth requires the exertion of a force thereby exercising the face, neck and chin. Moreover, the guard strip forces the lips to remain substantially spread out so that additional wrinkles or whistle marks do not form near the lips of the exerciser.

Preferably, the grip piece comprises two tabs separated from each other so that when the user bites down on the tabs, the upper teeth remain separated from the lower teeth during use. This will reduce the stress on the teeth, which is especially important if the user has, for example, periodontal disease, bridge work or dentures.

The method of exercising a mouth with an exerciser of the present invention is done by repetitiously forming O-shapes with the mouth. To position the exercise device in the mouth, the guard strip is positioned similar to how a mouth guard is positioned in the mouth. Then, the grip piece extending from the side of a central portion of the guard strip is gripped between the teeth. Then, the first and second anchors on the elastic member are drawn to the corners of the mouth. The exercises are carried out by expanding and contracting the elastic member, which is done by moving the mouth to form different shapes.

In alternate embodiment of the invention, the grip piece may comprise, for example, a bite plate, whereby the upper and lower teeth are substantially in contact with each other. However, with this embodiment of the invention, the user should preferably have healthy, strong teeth and should have sufficiently resilient skin to avoid any stress on the skin that may result from not using the space.

In another embodiment of the invention, the exercise device may comprise the elastic member alone. In this embodiment of the invention, the elastic band extending between the first and second anchors can be securely positioned behind either the upper or lower last set of teeth. Then, the anchors can be drawn towards the front of the mouth and anchored in each corner.

Other objects, advantages, and salient features of the invention will become apparent from the following detailed description, which, when taken in conjunction with the annexed drawings, discloses preferred embodiments of the invention.

BRIEF DESCRIPTION OF THE FIGURES

Referring now to the drawings which form a part of this original disclosure.

DETAILED DESCRIPTION OF PREFERRED EMBODIMENTS

Figure 1:
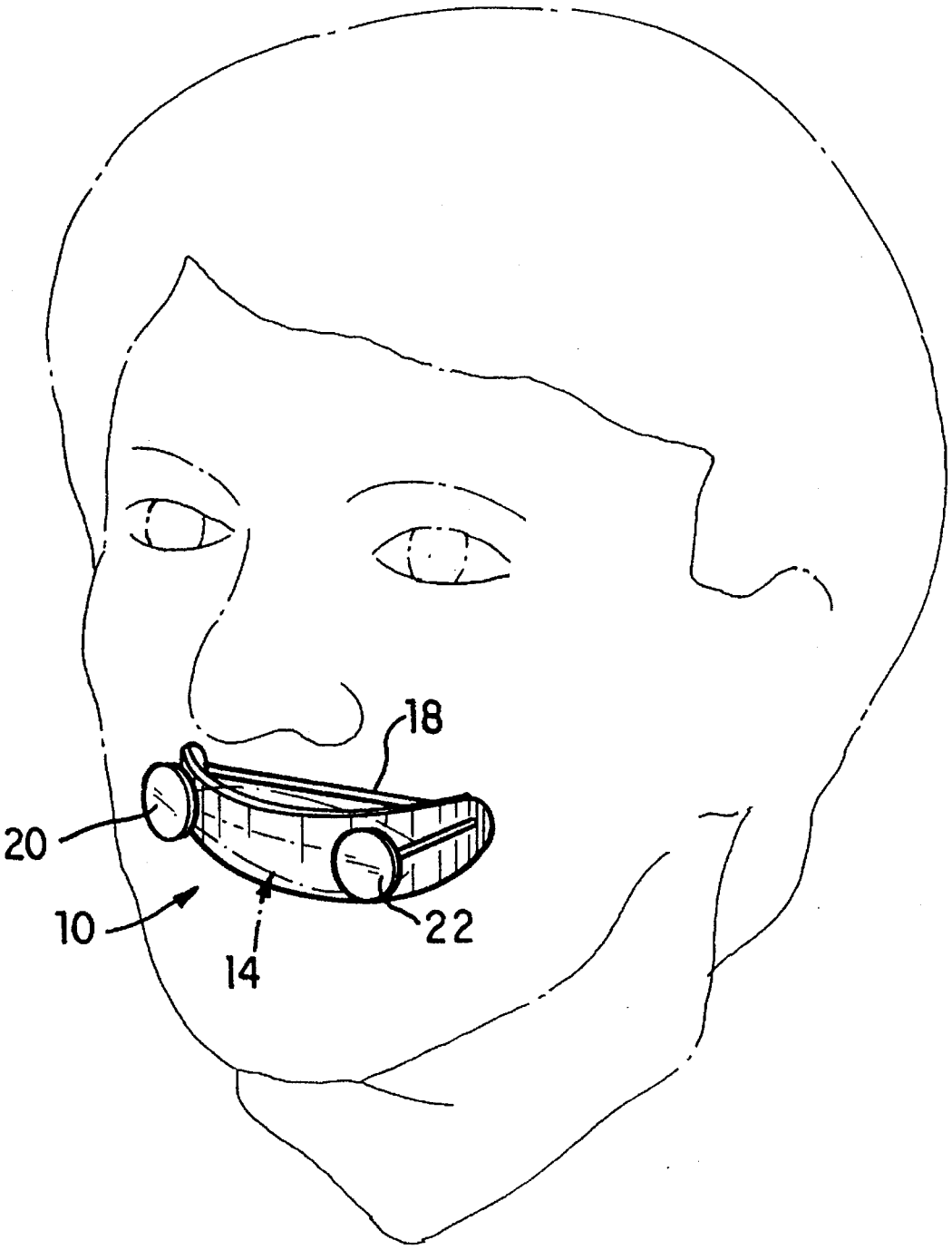
FIG. 1 shows a perspective view of the exercise device of the present invention, positioned for use in the mouth of an exerciser.

FIG. 1 shows a perspective view of an exercise device shown generally at 10. Exercise device 10 is shown positioned in the mouth of an exerciser. The head of the exerciser is shown in phantom in FIG. 1.

As an overview, exercise device 10 of the present invention is positioned in the mouth of the exerciser between the teeth and the inside of the mouth and lips. Exercise device 10 is held in the exerciser's mouth during use by biting down on a grip piece 16 (not shown in FIG. 1). An elastic member 12 extends from each rear corner of the mouth toward a front of the mouth and comprises an elastic band 18 and anchors 20 and 22. Anchor 20 on one end of elastic band 18 is positioned in one corner of the mouth, and anchor 22 on another end of elastic band 18 is positioned in another corner of the mouth thereby applying tension on elastic band 18. Accordingly, tension is applied on the corners of the mouth of the user such that movement of the mouth requires the use of facial, chin and neck muscles to overcome the resistance exerted by the tensioned elastic band 18.

Figure 2A:
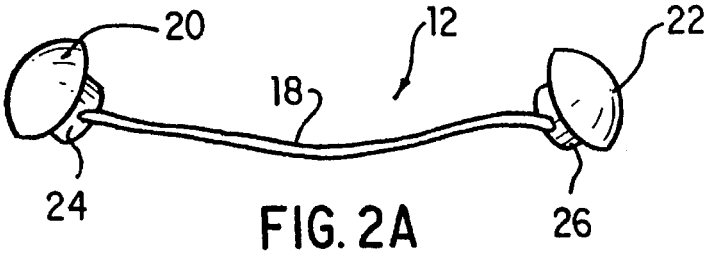
FIG. 2A shows an elastic member of the exerciser device of the present invention.
Figure 2B:
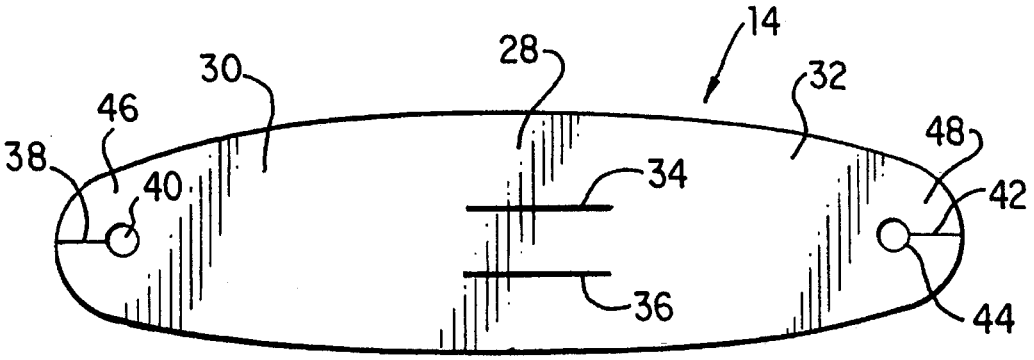
FIG. 2B shows a guard strip of the exerciser device of the present invention.
Figure 2C:
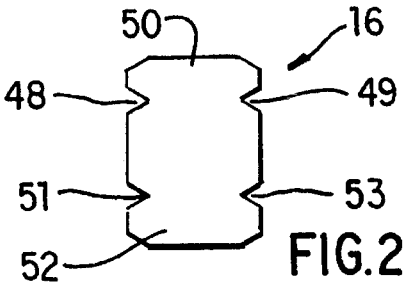
FIG. 2C shows a grip piece of the exerciser device of the present invention.

Referring now to FIGS. 2A–2C, exerciser device 10 is constructed from elastic member 12, guard strip 14, and grip piece 16. Elastic member 12 comprises elastic band 18 and button 20 attached to a first end of elastic band 18 and button 22 attached to a second end of elastic band 18.

Elastic band 18 may comprise differing degrees of elasticity, however, should have sufficient tension so as to exercise the muscles in the face and neck. In addition, a length of elastic band 18 may vary depending upon the elasticity of elastic band 18, as well as the size of the mouth of the exerciser.

Buttons 20 and 22 are shown to include shanks 24 and 26, respectively. Shanks 24 and 26 are provided on buttons 20 and 22 to supply additional comfort to the corners of the exerciser's mouth during exercise rather than having elastic band 18 rub against the corner of the user's mouth. Thus, the use of shanks 24 and 26 avoid elastic band 18 chaffing mouth corners. Anchors 20 and should be positioned slightly to the center of the mouth's corner to avoid chafing until the tissue becomes conditioned, which usually requires a couple of days of use of exercise device 10. However, at least initially, anchors 20 and 22 can be repositioned as frequently as desired during exercise. If discomfort in the corner of the mouth persists, the tension may be reduced by loosening elastic band 18.

Shanks 24 and 26 include passages passing therethrough. The first and second ends of elastic band 18 are passed through the passages and are preferably detachably connected to buttons 20 and 22. For example, elastic band 18 may be knotted or tied. Thus, the length of elastic band 18 may be changed by the exerciser to achieve the desired tension. This will allow the user to tailor the amount of tension for the desired needs, skill level and/or strength of the particular exerciser.

Referring now to FIG. 2B, guard strip 14 comprises an elongated, elliptically-shaped, flexible, thin member. Guard strip 14 includes a central portion 28 and a first leg 30 extending in a first direction from central portion 28 and a second leg 32 extending in a second direction opposite to the first direction from central portion 28. Slits 34 and 36 pass through central portion 28 and are positioned substantially parallel to each other. Slits 34 and 36 are preferably razor thin. Slits 34 and 36 are separated by a distance. Slits 34 and 36 are configured to receive grip piece 16, as will be discussed in greater detail in the following discussion.

A distal end 46 of first leg 30 includes a slit 38 extending inwardly from an outer periphery of guard strip 14 to communicate with an opening 40. Similarly, a distal end 48 of second leg 32 includes a slit 42 and opening 44. Slit 38 and opening 40 are adapted to frictionally receive and guide elastic band 18 into opening 40. In opening 40, elastic band 18 is slidably disposed without becoming readily dislodged from opening 40. Elastic member 18 is similarly disposed in slit 42 and opening 44.

When in the user's mouth, central portion 28 is positioned between the inside of the exerciser's upper and lower lips and the front of the user's upper and lower front teeth. First leg 30 is disposed along one side of the mouth so that the first leg is between the outside of the side of the teeth and the inside of the cheek. Second leg 32 is disposed along the other side of the mouth between the outside of the teeth and the inside of the cheek. Accordingly, when in position in the mouth, guard strip 14 comprises an arch shape.

FIG. 2C shows grip piece 16 having a tab 50 defined by V-shaped notches 48 and 49 and a tab 52 defined by V-shaped notches 51 and 53. Tabs 50 and 52 are slightly wider than a width of slits 34 and 36 for purposes of securing grip piece 16 in guard strip 14. Slits 34 and 36 in guard strip 14 have a width substantially equal to a width defined between notches 48 and 49, and 51 and 53, respectively. Because at least one of grip piece 16 and guard strip 14 are resilient, tabs 50 and 52 are frictionally passed through slits 34 and 36. For example, during construction, tabs 50 and 52 compress and/or slits 34 and 36 expand. However, once tabs 50 and 52 have passed through slits 34 and 36, tabs 50 and 52 and/or slits 34 and 36 resume their steady-state position such that grip piece 16 is secured to guard strip 14. Notches 48, 49, 51 and 53 serve to lock grip piece 16 in position in slits 34 and 36.

Figure 3:
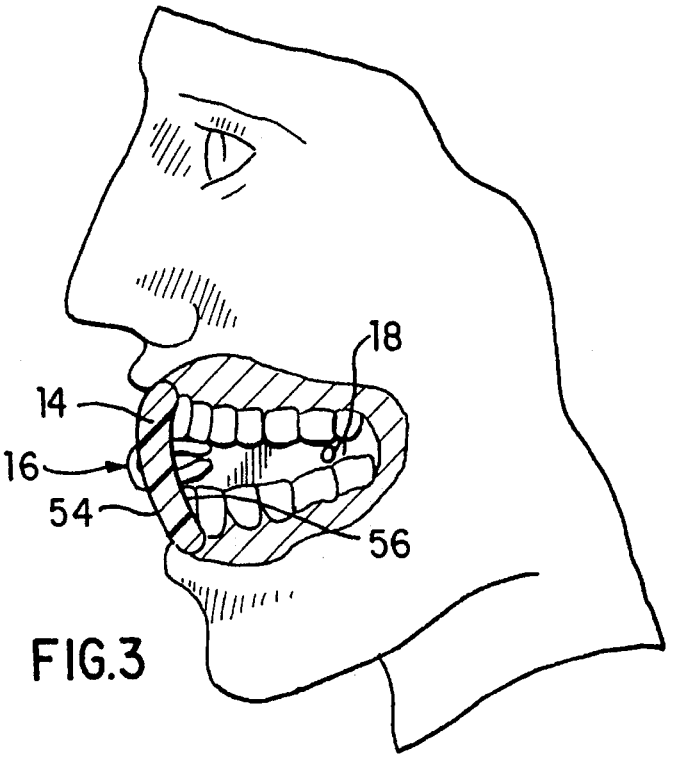
FIG. 3 shows a cross-sectional view of the exerciser device of the present invention as disposed in the mouth of the exerciser.

As discussed above, slits 34 and 36 in guard strip 14 are separated by a distance. Similarly, a distance between notches 48 and 49, and 51 and 53 is made to be substantially equal to the distance between slits 34 and 36. This distance is provided so that when the upper and lower teeth of the exerciser bite down on grip piece 16, the upper and lower teeth remain separated from each other. Accordingly, the distance between slits 34 and 36 may be approximately equal to a quarter inch to three-quarters of an inch thereby allowing the user's teeth to be separated by approximately the same distance, as illustrated in FIG. 3. Accordingly, the exerciser's teeth will not be clenched together during use of exercise device 10, thereby reducing stress and strain on the wearer's teeth and jaw.

Guard strip 14 and grip piece 16 may be made of a flexible material that can be easily cleaned and hygienically maintained. For example, materials approved by the FDA for safety for use in the mouth may be used. For example, guard strip 14 and grip piece 16 may comprise a sealed-cell polymer foam. Similarly, elastic member 12 may comprise material that is clean and safe for use in the mouth. For example, elastic member 12 may comprise rubber, such as a rubber band. Finally, anchors 20 and 22 should comprise a more rigid material such as a plastic, for example, a plastic button such that anchors 20 and 22 provide sufficient rigidity so as not to fail under pressure and tension from elastic band 18.

FIG. 3 illustrates how the exerciser's upper and lower teeth bite on grip piece 16, however, remain separated due to the distance between slits 36 and 34, which results in tabs 50 and 52 being separated from each other. As shown in FIG. 3, upper and lower lips cover a significant portion of a front side 54 of guard strip 14 and the front of the upper and lower teeth press against a rear side 56 of guard strip 14. Also shown in FIG. 3 is elastic band 18 disposed in the rear of the mouth. Elastic band 18 spans from one side of the mouth to the other side of the mouth so as to be substantially perpendicular to the rows of teeth on either side of the mouth.

Figure 4:
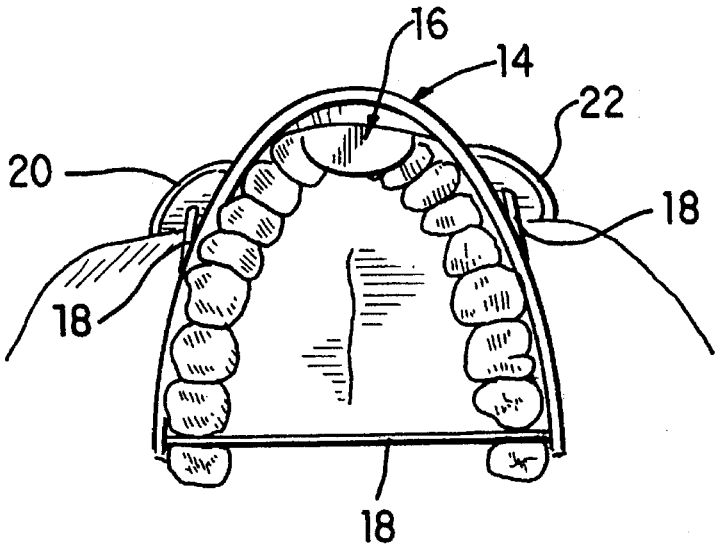
FIG. 4 shows an elevational view of a top of the mouth showing a position of the exerciser device of the present invention in position for use.

As shown in FIG. 4, guard strip 14 is of a length such that it extends around the perimeter of the teeth, however, preferably ends just before the last teeth. This embodiment is preferable when, for example, the exerciser has dentures, so as not to interfere with the dentures. Moreover, with this embodiment, elastic member 12 does not have to be worn behind the molars and can be used with dentures or partial plates having back molars that are sloped toward the front of the mouth. However, it is possible to have guard strip 14 extend further into the mouth or not so far in the mouth. As illustrated in FIG. 4, in use, elastic member 12 is configured in a substantially arch shape that opposes the arch shape of guard strip 14.

Specifically, elastic band 18 of elastic member 12 is stretched from a rear of the mouth towards the front of the mouth such that anchors 20 and 22 may be anchored in the corners of the mouth. As a result, anchor 20 is anchored in one corner of the mouth, elastic band 18 extending from anchor 20 extends along first leg 30 of guard strip 14, passes through opening 40 of guard strip 14, crosses the back of the mouth from one side to the other side passes through opening 44 in distal end 48 of second leg 32 in guard strip 14 continues on along the outside of second leg 32 and attaches to anchor 22 in the other corner of the mouth.

Figure 5:
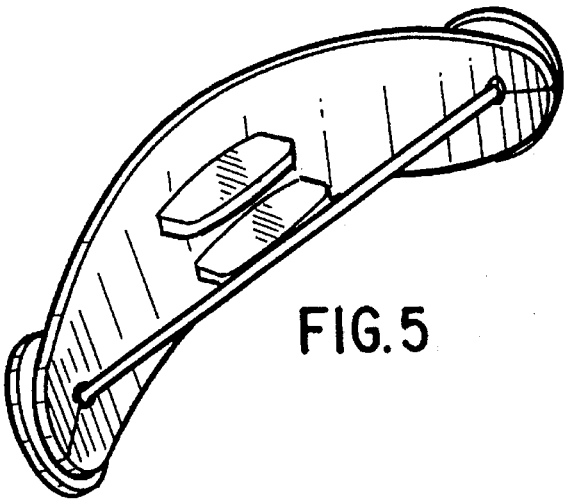
FIG. 5 shows a perspective view of the exerciser device of the present invention in a relaxed position.

FIG. 5 shows exercise device 10 in a relaxed position outside of the mouth.

Figure 6:
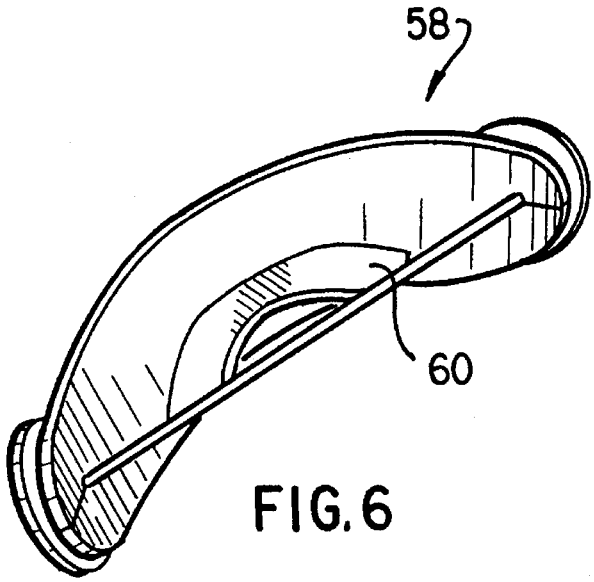
FIG. 6 shows a second embodiment of the exerciser device of the present invention in a relaxed position.

FIG. 6. shows a second embodiment of an exercise device of the present invention shown generally at 58 in a relaxed position outside of the mouth. Exercise device 58 is similar to exercise device 10, however includes a bite plate 60 for grip piece 16. With the use of bite plate 60, the upper and lower teeth touch each other which may cause problems for exercisers who have dentures, bridges, caps, or otherwise due to the pressure exerted by the clenching of the teeth.

Figure 7:
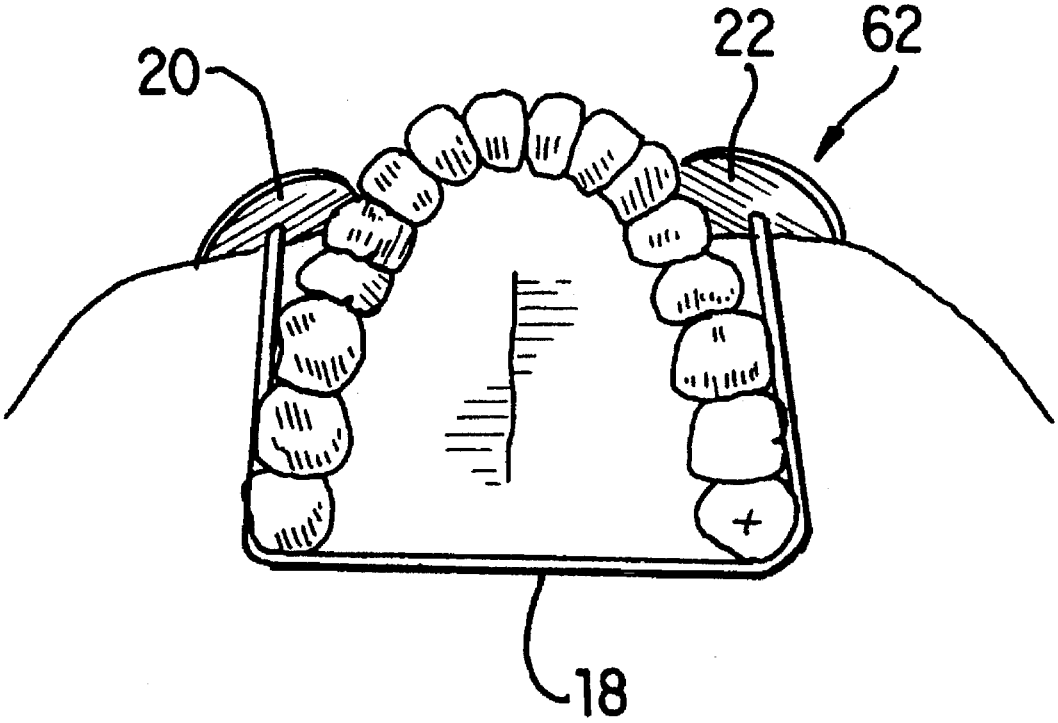
FIG. 7 shows an elevational view of a third embodiment of an exerciser device of the present invention positioned in an exerciser's mouth for exercising.

FIG. 7 shows a third embodiment of the invention where an exercise device 62 is utilized and shown positioned for use in the mouth. Exercise device 62 comprises elastic member 12, as discussed above, however, is used alone without guard strip 14 or grip piece 16. Exercise device 62 is fixed in the mouth by positioning elastic band 18 behind the last teeth (wisdom or molars) in the mouth. Then, anchors 20 and 22 can be drawn out to the corners of the mouth. Elastic band 18 may be positioned behind the last set of upper teeth or the last set of lower teeth.

In use, the exercise device of the present invention is worn inside the mouth so as to cover the outside surfaces of the teeth like an athletic mouth guard and the lips are drawn over the outside of the exercise device. During exercising, the corners of the mouth should be drawn back as far as possible, as if to smile broadly, then the corners of the mouth should be brought together in a tight letter "O". When the lips are drawn back the amount of tension in the elastic band is reduced. When, the lips are contracted to form the letter "O", the tension of the elastic band is gradually increased. During this movement to form the letter "O", muscles move in unison from the neck up to the eyebrows. By doing this exercise, cheek bones are enhanced, the mouth and chin are raised, and the fatty tissue on the jaw line is tightened.

By using grip piece 16 the exercise device will not apply pressure to the teeth to such a degree as to displace teeth weakened by periodontal disease, nor will it cause pressure points on the teeth that have been capped. Moreover, guard strip 14 of the present invention keeps the lips of the mouth from tightly puckering which may cause or exacerbate wrinkles extending perpendicularly from the lips, which are often referred to as "whistle-marks." Finally, elastic member 12 provides for adjustable tension so that the user can tailor the exercise devices of the present invention to his/her particular needs.

The exercise device of the present invention may be used in special exercise routines to exercise the muscles in the face, neck and chin so that lines, crevasses and folds in the skin will be smoothed out or completely eliminated; enhanced cheek bones will be achieved; eyebrows will have a pronounced arch; eyes will appear larger and younger; the jaw line will be cleaner; the chin line will be more distinct; and the corners of the mouth will no longer droop.

In accordance with the present invention, because the exercise device of the present invention covers the teeth, the exercise device may be used with partial plates, bridge work, periodontal disease or gum disease. Specifically, people with partial plates in the rear of the mouth can use the invention as shown, for example, in FIG. 4, because the elastic does not have to be mounted on the molars and therefore will not slide off the molars.

Moreover, because the exercise device of the present invention is made from flexible, resilient and relatively soft materials, the product is very safe and can be used, for example, while driving a car or engaging in sports or athletic activities without the fear of injury.

Although the invention has been described as being constructed from a plurality of separate parts, it is within the scope of the invention to form any or all of the parts as a single unit or any other combinations of units.

Moreover, although the invention is described so that a single elastic band extends from one corner of the mouth, across the back of the mouth and out to the other corner of the mouth, it is within the scope of the invention to use two elastic members; where the first elastic member is attached to the first anchor at one end and is attached to the opening in one distal end of the mouth guard at the other end of the first elastic band. Similarly, the second elastic member is attached to the second anchor at one end and is attached to the opening in the other distal end of the mouth guard at the other end of the second elastic band.

While advantageous embodiments have been chosen to illustrate the invention, it will be understood by those skilled in the art that various changes and modifications can be made therein without departing from the scope of the invention as defined in the appended claims.

What is claimed is:

1. An exercise device adapted to be positioned in an exerciser's mouth, said exercise device comprising;

an elongated continuous elastic member that is nonrigid, said elongated elastic member having a first end and a second end;

a first anchor disposed at said first end of said elastic member adapted to be positioned in a first corner of the exerciser's mouth; and a second anchor disposed at said second end of said elastic member adapted to be positioned in a second corner of the exerciser's mouth, such that said elastic member exerts tension on the exerciser's mouth during exercise.

2. An exercise device adapted to be positioned in an exerciser's mouth, said exercise device comprising:

a guard strip having a central portion with a first leg extending from said central portion and a second leg extending from said central portion in a direction opposing said first leg;

a grip piece extending from a side of said central portion of said guard strip; and an elastic member in connection with said guard strip having a first end with a first anchor and a second end with a second anchor, wherein said first and second anchors are adapted to be positioned in the corners of the exerciser's mouth such that said elastic member exerts tension on the exerciser's mouth during exercise.

3. An exercise device according to claim 1, wherein said guard strip further comprises a pair of slits in said central portion and said grip piece comprises a shank having a first tab at a first end of said shank and a second tab at a second end of said shank, wherein the first tab passes through one of said pair of slits and said second tab passes through another of said pair of slits.

4. An exercise device according to claim 1, wherein said first leg has an opening for slidably receiving said elastic member and said second leg has an opening for slidably receiving said elastic member.

5. An exercise device according to claim 1, wherein said guard strip is concave and said side with said grip piece is at an interior of the concave.

6. An exercise device according to claim 1, wherein said grip piece comprises a first tab extending from said side of said guard strip and a second tab extending from said side of said guard strip, wherein said first tab is spaced apart from and substantially adjacent to said second tab.

7. An exercise device according to claim 1, wherein said elastic member comprises an elongated elastic member that comprises substantially a convex shape, when in use, which opposes said concave shape of said guard strip.

8. An exercise device according to claim 7, wherein said side of said central portion of said guard strip comprises a first side and said guard strip has a second side opposing said first side and said first leg has a first distal end for receiving said elongated elastic member and said second leg has a second distal end for receiving said elongated elastic member, wherein said elongated elastic member extends adjacent to said second side of said first leg, through said first distal end, through said second distal end and adjacent to said second side of said first leg.

9. An exercise device according to claim 1, wherein said elastic member comprises an elastic band.

10. An exercise device according to claim 1, wherein said first anchor comprises a first button having a first shank and said second anchor comprises a second button having a second shank, wherein said first end and said second end of said elastic member are attached to said first shank and said second shank respectively.

11. An exercise device adapted to be positioned in an exerciser's mouth, said exercise device comprising:

a guard means adapted to be positioned between teeth and inside of the mouth and lips, said guard means having a central portion and a first leg extending from said central portion and a second leg extending from said central portion in a direction opposing said first leg;

a grip means adapted to be gripped by the teeth, wherein said grip means extends from a side of said central portion of said guard strip;

an elastic means adapted to be positioned in the exerciser's mouth and expanded and contracted during exercise, wherein said elastic means is in cooperation with said first and second legs;

a first anchor means for anchoring in a corner of the mouth, wherein said first anchor means is disposed on an end of said elastic means; and a second anchor means for anchoring in another corner of the mouth, wherein said second anchor means is disposed on another end of said elastic member.

12. An exercise device according to claim 11, wherein said first anchor means comprises a first button having a first shank and said second anchor means comprises a second button having a second shank, wherein said elastic means is attached to said first shank and said second shank.

13. A method for exercising a mouth with an exercise device by forming O-shapes with the mouth, comprising the steps of:

gripping a grip piece extending from a side of a central portion of a guard strip;

tensioning an elastic member that is in cooperation with the guard strip by anchoring a first anchor on the elastic member in a first corner of the mouth and anchoring a second anchor on the elastic member in a second corner of the mouth; and varying the tension on the elastic member by expanding and contracting the elastic member by moving and forming the shapes with the mouth.

* * * * *